US005346456A

United States Patent [19]

Rutledge et al.

[11] Patent Number: 5,346,456

[45] Date of Patent: Sep. 13, 1994

[54] PLASTIC FILM BAG MANUFACTURING APPARATUS AND ASSOCIATED METHODS, AND PLASTIC FILM BAGS PRODUCED THEREBY

[75] Inventors: Gary L. Rutledge; Edgar R. Pitcher, both of Dallas, Tex.

[73] Assignee: John C. Marrelli, Tustin, Calif.

[21] Appl. No.: 18,834

[22] Filed: Feb. 18, 1993

Related U.S. Application Data

[60] Division of Ser. No. 389,757, Aug. 4, 1989, Pat. No. 5,188,580, which is a continuation-in-part of Ser. No. 117,209, Nov. 4, 1987, Pat. No. 4,854,735.

[51] Int. Cl.[5] ..... B31B 1/90

[52] U.S. Cl. ..... 493/211; 493/214; 493/225; 493/224

[58] Field of Search ..... 383/70, 71, 72, 74, 383/76, 77; 493/14, 18, 29, 22, 194–196, 201, 209, 211, 212, 213, 214, 215, 345, 380, 225, 226, 227, 223, 224; 226/2, 3, 8, 108, 115, 117, 118, 119

[56] References Cited

U.S. PATENT DOCUMENTS

| | | | |
|---|---|---|---|
| 492,071 | 2/1893 | Vaughan . | |
| 893,759 | 7/1908 | Thomas . | |
| 1,181,148 | 5/1916 | Linton . | |
| 2,849,171 | 8/1958 | O'Brien | 229/63 |
| 2,920,670 | 1/1960 | Mohlmann | 150/5 |
| 2,980,314 | 4/1961 | Adams | 229/65 |
| 3,285,309 | 11/1966 | Northcott | 150/11 |
| 3,412,926 | 11/1968 | Bostwick | 229/62 |
| 3,481,461 | 12/1969 | Paxton | 206/56 |
| 3,575,339 | 4/1971 | Kupcikevicius | 493/214 |
| 3,633,247 | 1/1972 | Clayton | 24/305 PB |
| 3,653,584 | 4/1972 | Lake | 229/62 |
| 3,662,434 | 5/1972 | Clayton | 24/305 P |
| 3,664,575 | 5/1972 | Lake | 229/62 |
| 3,679,126 | 7/1972 | Lake | 229/62 |
| 3,716,182 | 2/1973 | Koon | 229/62 |
| 3,752,388 | 8/1973 | Lynch | 229/54 R |
| 3,794,545 | 2/1974 | Lucas | 493/214 |
| 3,865,303 | 2/1975 | Korn | 229/62 |
| 3,889,872 | 6/1975 | Lin | 229/63 |
| 3,945,036 | 3/1976 | Karsh | 226/118 |

(List continued on next page.)

FOREIGN PATENT DOCUMENTS 878245 8/1971 Canada .

(List continued on next page.)

*Primary Examiner*—Jack W. Lavinder
*Attorney, Agent, or Firm*—Harris, Tucker & Hardin

[57] ABSTRACT

An in-line machine for attaching elongated, flexible closure tie elements to the individual bag portions of a laterally folded plastic film web being continuously discharged from a bag forming station, and being forcibly captured by a winder mechanism, engages and drives the moving web toward the winder mechanism by means of mutually spaced inlet, central and outlet drive rollers. During operation of the machine, first and second slack portions of the film web are respectively positioned between the inlet and central rollers, and between the central and outlet rollers. These slack portions are held in vertically looped configurations by a downwardly directed, yielding vacuum force applied thereto. The inlet and outlet rollers are driven at identical speeds corresponding to the constant linear film web output speed from the bag forming station. The central drive roller is alternately started and stopped to sequentially cause a portion of each bag to be momentarily stopped thereon, at which time the machine attaches a tie element to the stopped bag portion. During stoppage of each sequential bag portion, continued rotation of the inlet and outlet rollers lengthens the first film loop and shortens the second film loop. When the central drive roller is restarted it operates to equalize the film loop lengths. In this manner, each bag may be momentarily stopped, for tie element attachment purposes, without altering the constant output and input speeds of the bag forming station and winder mechanisms, and without imposing undesirably high longitudinal tension force on the plastic film web.

12 Claims, 5 Drawing Sheets

U.S. PATENT DOCUMENTS

| | | | |
|---|---|---|---|
| 3,974,960 | 8/1976 | Mitchell | 229/62 |
| 3,982,687 | 9/1976 | Auer et al. | 229/62 |
| 4,008,851 | 2/1977 | Hirsch | 229/62 |
| 4,077,562 | 3/1978 | Ballin | 229/62 |
| 4,445,230 | 4/1984 | Spadaro | 383/7 |
| 4,477,822 | 10/1984 | Luoma et al. | 226/118 |
| 4,753,538 | 6/1988 | Jorda | 383/8 |
| 4,778,283 | 10/1988 | Osborn | 383/71 |
| 4,786,189 | 11/1988 | Broderick et al. | 383/75 |
| 4,786,191 | 11/1988 | Broderick et al. | 383/75 |
| 4,792,241 | 12/1988 | Broderick et al. | 383/75 |
| 4,813,794 | 3/1989 | Herrington | 383/75 |

FOREIGN PATENT DOCUMENTS

| | | |
|---|---|---|
| 0315176 | 5/1989 | European Pat. Off. . |
| 47-32722 | 12/1972 | Japan . |
| 48-10817 | 2/1973 | Japan . |
| 51-33129 | 3/1976 | Japan . |
| 53-30413 | 3/1978 | Japan . |
| 53-51822 | 5/1978 | Japan . |
| 54-94978 | 7/1979 | Japan . |
| 55-139053 | 10/1980 | Japan . |
| 55-150751 | 10/1980 | Japan . |
| 56-36602 | 4/1981 | Japan . |
| 56-100401 | 8/1981 | Japan . |
| 61-178850 | 8/1986 | Japan . |
| 61-144043 | 9/1986 | Japan . |
| 62-4062 | 1/1987 | Japan . |
| 62-33540 | 2/1987 | Japan . |
| 62-95546 | 6/1987 | Japan . |
| 63-57247 | 4/1988 | Japan . |

PLASTIC FILM BAG MANUFACTURING APPARATUS AND ASSOCIATED METHODS, AND PLASTIC FILM BAGS PRODUCED THEREBY

CROSS-REFERENCE TO RELATED APPLICATION

This application is a division, of application Ser. No. 07/389,757, filed Aug. 4, 1989, now U.S. Pat. No. 5,188,580, which is a continuation-in-part of U.S. application Ser. No. 117,209, filed on Nov. 4, 1987 U.S. Pat. No. 4,854,735 and entitled "PLASTIC FILM BAG WITH INTEGRAL PLASTIC FILM TIE ELEMENT, AND ASSOCIATED FABRICATION METHODS", which is hereby incorporated by reference herein.

BACKGROUND OF THE INVENTION

The present invention relates generally to the manufacture of plastic film bags and, in a preferred embodiment thereof, more particularly provides apparatus and methods for attaching to the bags plastic film tie elements which, as disclosed in my copending U.S. application Ser. No. 117,209, may be tied around the open tops of the bags to tightly close them.

In the manufacture of plastic film bags it is common practice to form them, by continuously extruding plastic film in tubular form, flattening the film tube to form a double layer "web", forming lateral weld lines and perforation lines across the web to define the individual bags which may be subsequently separated from one another at the perforation lines, and then laterally folding the web prior to packaging of the bags. The laterally folded film web is then typically delivered to a packaging station spaced apart from the bag forming station, at a linear receiving speed identical to the linear output speed of the bag forming station, where it is rolled or folded for packaging.

For the purpose of attaching accessories to, forming logos or heat seals on, or otherwise modifying the individual bags prior to their receipt at the packaging station, it is desirable to momentarily stop the web at each bag during the performance of a particular modification operation thereon—for example, the attachment of a plastic film tie element disclosed in U.S. application Ser. No. 117,209 incorporated by reference herein.

There are presently two methods for effecting this necessary momentary stoppage of the web as each individual bag passes the modification station—neither of which is wholly satisfactory. First, both the bag forming station output feed portion and the packaging station input drive may be synchronously operated in a start-stop fashion to incrementally advance and then stop the entire folded film web section extending between these two operating stations. While this is a quite logical approach, it significantly slows the overall bag production rate —a rate which must be kept as high as possible for profitability purposes.

Second, a rather complex, high mass, shiftable multi-roller structure may be utilized to engage and intermittently stop a portion of the folded plastic film web between the bag forming station and the winder without slowing or interrupting the output and input web travel at these portions of the overall bag forming apparatus. However, this high mass roller structure must be very rapidly shifted back and forth to stop each individual bag received thereby during the high speed bag forming process. Because of the rapidity with which the multi-roller structure must be intermittently shifted back and forth, very high shift forces result, requiring substantial power and precision control. If the multi-roller structure is not precisely designed and adjusted, these high shift forces can easily tear the travelling film web at one of its perforation lines, creating significant down time and waste in the bag manufacturing process.

In view of the foregoing it can be seen that improved apparatus and methods for momentarily stopping each individual bag in the film web, during its movement between the bag forming station and the winder, are needed. It is accordingly an object of the present invention to provide such improved apparatus and methods.

SUMMARY OF THE INVENTION

In carrying out principles of the present invention, in accordance with a preferred embodiment thereof, an in-line closure tie element attachment machine is positioned between a plastic film bag forming station, which continuously produces a folded plastic film web divided into individual bags by longitudinally spaced perforation lines, and a winder mechanism which forcibly captures the folded web at a continuous linear velocity equal to the continuous linear output velocity of the bag forming station. A web handling portion of the flexible tie element attachment machine grips the moving web, and advances it toward the winder, with driven roller means including an inlet drive roller, an outlet drive roller spaced apart from the inlet drive roller toward the winder mechanism and a central drive roller positioned between the inlet and outlet drive rollers in a laterally spaced, parallel relationship therewith.

Positioned beneath these three drive rollers are first and second intercommunicating vacuum bins, the first vacuum bin having an open upper end positioned generally between the inlet and central drive rollers, and the second vacuum bin having an open upper end positioned generally between the central and outlet drive rollers. Vacuum pump means are connected to lower end portions of the bins for creating vacuums therein during machine operation.

As the folded web is drawn through the web handling portion of the tie element attachment machine by the three drive rollers, control means associated with the machine rotate the inlet and outlet drive rollers at continuous speeds respectively corresponding to the linear web output and intake speeds of the bag forming station and the winder mechanism. However, the control means intermittently operate the central drive roller, preferably via a stepper motor, in a manner such that the central drive roller is sequentially stopped, accelerated to a rotational drive speed higher than those of the inlet and outlet rollers, decelerated, and then stopped again.

Each sequential stop-to-stop drive cycle of the stepper motor-driven central roller longitudinally advances the portion of the web engaged by such roller a predetermined distance so that corresponding longitudinal sections of the individual bags, to which flexible tie elements are to be attached, are successively and momentarily stopped on the central drive roller, at which time a tie element attachment portion of the machine affixes a tie element to the stopped bag.

During operation of the tie element attachment machine first and second slack portions of the advancing web are respectively positioned between the inlet and central drive rollers, and between the central and outlet driver rollers. The vacuums formed in the first and second vacuum bins exert yielding, downwardly directed forces on the first and second slack web portions, created by air pressure differentials across the web portions, pulling web portions downwardly into the bins and positively, but rather gently, holding them in downwardly extending first and second web loop configurations.

At the time the central drive roller is initially stopped, to stationarily position one of the bags for tie element attachment thereto, the first web loop is considerably longer than the second web loop. During tie element attachment to the momentarily stopped bag portion of the web, the first web loop lengthens, and the second web loop shortens, within their respective vacuum bins as the inlet and outlet drive rollers continue to be driven at constant rotational speeds, the outlet roller taking slack out of the second loop while the inlet roller adds slack to the second web loop. The slack takeup capability provided by the vacuum-supported second loop prevents the still-running outlet drive roller from imposing tension force on the web sufficient to tear it at one of its perforation lines positioned on the second loop. Additionally, the slack provided in the two web loops permits sequential bag stoppage without altering or interrupting the continuous, constant linear web output and intake velocities at the bag forming station and the packaging station winder mechanism, respectively. Accordingly, a very high bag production rate may be maintained.

After its tie element is attached to the momentarily stopped bag, the central drive roller is accelerated, held at a constant elevated speed, decelerated, and then restopped, as previously described, to stop the next longitudinally successive bag thereon for tie element attachment thereto. This rotation cycle of the central drive roller takes up slack in the lengthened first loop, and adds the taken-up slack to the shortened second loop, to return the two web loops to their original length relationship at the time the central drive roller is stopped at the end of its drive cycle. The rapid take-up of the slack in the first loop is achieved against the yielding, downwardly directed vacuum force thereon so that the web is not torn at one of the perforation lines in its first loop portion. Additionally, this slack take-up and loop length readjustment does not alter or interrupt the constant velocity of the web entering and exiting the tie element attachment machine.

The control means may be adjusted to compensate for different bag lengths being run through the machine, and the vacuum bins are provided with movably adjustable front side walls to compensate for changes in the width of the particular folded plastic film web upon which the individual bags are formed.

The lengths of the vertically oscillating web loops within the first and second vacuum bins are continuously monitored by means of vertically spaced series of photoelectric beam transmitters and associated receivers which input loop positional information to the control means to permit appropriate corrective action to be taken should either of the loops become too long or too short during machine operation.

Additionally, the longitudinal position of each successive bag stopped on the central drive roller is continuously monitored by a unique perforation detection system which senses the position of the openable end perforation line of each bag just before the bag is stopped on the central drive roller. The perforation detection system, in a preferred embodiment thereof, includes a high voltage electrode member spaced horizontally apart from an insulation-housed conductor supported on a central common wall structure separating the first and second vacuum bins. The electrode is pivotably supported within the first vacuum bin and, in the event that the first web loop greatly shortens, is adapted to be engaged by the shortened loop and be swung out of the first bin to prevent web tearing or separation at one of the perforation lines.

The folded web portion approaching the central drive roller is routed between the electrode and the conductor so that the web perforation lines successively pass therebetween. A high voltage is suitably impressed on the electrode so that as each perforation line vertically passes the electrode the electrode discharges to the conductor through the passing perforation area, thereby energizing an associated current sensor. Energization of the current sensor causes it to transmit an output signal to a microprocessor portion of the control means indicating the passage of another perforation line past the electrode. This information is appropriately correlated to the rotational drive characteristics of the central drive roller to continuously monitor the longitudinal orientation of each individual bag stopped thereon.

In the event that the individual bags begin to be longitudinally mispositioned relative to the central drive roller at which they momentarily stopped (due, for example, to minor drive roller slippage), the microprocessor automatically adjusts the rotation of the central drive roller to correct the mispositioning.

The tie element attachment portion of the machine is pivotally mounted on the web handling portion thereof, above the inlet and central drive rollers, and rotationally supports a supply roll of an elongated plastic film web used to form the individual tie elements. During operation of the machine the plastic film web on the tie element supply roll is pulled therefrom and incrementally advanced, above the inlet and central drive rollers and the folded plastic film bag web, toward the winder mechanism. As the tie element web approaches the central drive roller a slitter knife transversely cuts it into the individual flexible tie elements which are sequentially moved to positions directly over the central drive roller, and the stopped longitudinal bag sections thereon, by a vacuum belt.

The inner end of each tie element is then heat welded to a qusseted side edge portion of its associated bag, adjacent the openable end thereof, by means of a first reciprocating heating die which also forms a slit through the inner tie element end portion and the underlying gusseted side edge portion of the bag.

The heat weld on the inner end of the tie element extends through all four plastic film layers of the gusseted side edge portion of the associated bag. Accordingly, very high strength connection is achieved between the flexible tie element and its associated bag.

To maintain each tie element in an extended position across an outer side surface of its laterally folded bag, to facilitate packaging of the bags, the outer end of each tie element is releasably restrained against such outer side surface of its laterally folded bag. While this releasable restraint can be accomplished in a variety of manners, it is accomplished in a preferred embodiment of the present invention using a second reciprocating heating die which functions to form by both mechanical force and thermal deformation, a series of "dimples" in each outer tie element end which extend into corresponding depressions formed in the underlying layer of plastic bag film. The interlock between these dimples and bag film depressions keep the tie elements from flapping about during packaging of their associated bags, but later permit each outer tie element end to be easily separated from its associated bag without tearing a hole in the bag.

When a bag is ultimately detached from the laterally folded plastic film web, the outer tie element is simply pulled outwardly from and detached from the bag. The tie element is then looped around the open bag end to form a tightening loop therearound. Finally, the now detached outer tie element end is passed through the slit in the inner tie element end and pulled to tighten the tie element loop around the open bag end and tightly close it. The slit length is preferably somewhat shorter than the tie element width so that as the tie element is passed through the slit the tie element is crumpled and gathered in a manner inhibiting loosening of the tie element loop around the bag.

The tie element attachment machine of the present invention may be conveniently placed "in-line" in an existing plastic film bag forming system, and the web handling portion of the machine may be used to sequentially stop spaced longitudinal sections of the continuously moving bag web for purposes other than tie element attachment.

DETAILED DESCRIPTION

Figures 1, 1A, 2, 3, 4, 4A, 5, 6, 6A, 7, 7A:
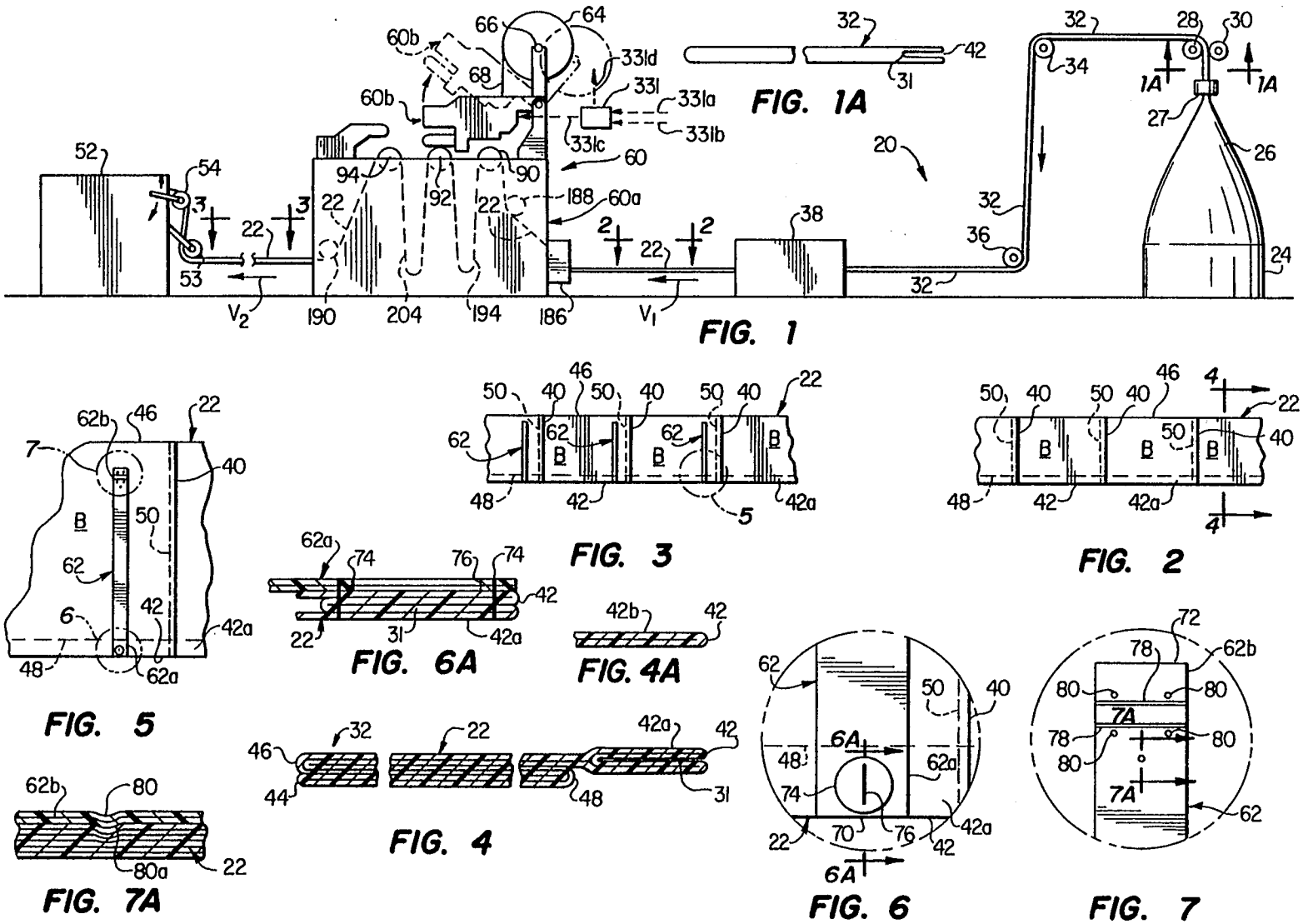
FIG. 1 is a simplified schematic side elevational view of a conventional in-line plastic film bag manufacturing system in which a tie element attachment machine of the present invention is operably interposed to attach to each of the individual bag portions of the moving plastic film web a flexible plastic film tie element which may be wrapped and cinched around the open bag end to tight close it.
FIG. 1A is an enlarged scale, horizontally foreshortened cross-sectional view, taken along line 1A—1A of FIG. 1, through a side edge-gusset, plastic film web being produced by the system.
FIG. 2" is a top plan view of the moving plastic film web, prior to its entry into the tie element attachment machine, taken along line 2—2 of FIG. 1.
FIG. 3 is a top plan view of the moving plastic film web exiting the tie element attachment machine, taken along line 3—3 of FIG. 1.
FIG. 4 is an enlarged scale, horizontally foreshortened cross-sectional view through the moving plastic film web, taken along line 4—4 of FIG. 2, illustrating the representative manner in which it is laterally folded.
FIG. 4A is a cross-sectional view of a non-gusseted alternate embodiment of the overhanging right side edge portion of the plastic film web depicted in FIG. 4.
FIG. 5 is an enlargement of the circled area "5" in FIG. 3.
FIG. 6 is an enlargement of the circled area "6" in FIG. 5.
FIG. 6A enlarged scale partial cross-sectional view through the film web, and the inner end of a flexible tie element, taken along line 6A—6A of FIG. 6.
FIG. 7 is an/enlargement of the circled area "7" in FIG. 5.
FIG. 7A is an enlarged scale partial cross-sectional view through an outer tie element end, and an underlying bag web portion, taken along line 7A—7A of FIG. 7.

Schematically illustrated in FIG. 1 is a plastic film bag forming station 20 which, during operation thereof, outputs a laterally folded plastic film web 22 (see also FIGS. 2 and 3) at a constant linear longitudinal speed $v_1$. The bag forming station 20 includes a plastic extrusion die 24 which continuously extrudes, in an upward direction, a plastic film tube 26. Tube 26 is passed upwardly through a gusset forming structure 27, and then between a pair of flattening rollers 28 and 30, to convert the tube to a flattened tube or "web" 32 (see also FIG. 1A) exiting the rollers 28, 30 and having a side edge portion 42 with an inwardly extending gusset 31 extending along its length, the gusset being defined by four layers of plastic film. After its exit from the rollers 28 and 30, the web 32 is sequentially passed over the rollers 34 and 36 and fed through a heat sealing, folding and perforation apparatus 38.

The schematically depicted apparatus 38, as its name implies, sequentially performs three operations on the web 32 traversing the apparatus. First, it forms on the web a longitudinally spaced series of laterally extending heat seal weld lines 40, each of which extends between the side edge 42 of the web 32 and its opposite side edge 44 (see FIG. 4).

Next, as cross-sectionally illustrated in FIG. 4, the web 32 is laterally folded along the longitudinally extending fold lines 46 and 48, the fold line 46 being laterally aligned with the side edge 44, and the fold line 48 being laterally inset from the side edge 42. As best seen in FIG. 4, the lateral inset of the fold line 48 causes a side edge portion $42_a$ (containing the gusset 31) to extend laterally beyond the balance of the laterally folded, flattened film tube which ultimately defines the laterally folded plastic film web 22. The number of folds in the folded web 22 are, of course, merely representative—a greater or lesser number of folds could be formed.

After the web 32 has been heat sealed along lines 40, and laterally folded as just described to create the folded web 22, the apparatus 38 operates to form on the folded web 22 a longitudinally spaced series of laterally extending perforation lines 50 which extend completely across and through the laterally folded, web 22. As illustrated in FIG. 2, each of the perforation lines 50 is positioned leftwardly adjacent one of the heat seal lines 40. Accordingly, the heat seal lines 40 and the perforation lines 50 form on the laterally folded plastic film web 22 exiting the apparatus 38 a longitudinal series of laterally folded individual plastic film bags B which may ultimately be separated from one another by tearing the film web 22 along the perforation lines 50. When this is done, each individual bag, in the usual manner, has an openable end extending along one of the perforation lines 50, and a closed, opposite end extending along one of the heat seal lines 40.

Referring again to FIG. 1, the laterally folded plastic film web 22 exiting the apparatus portion 38 of the bag forming station 20 is forcibly captured in a conventional winder mechanism 52, spaced apart in a leftward direction from the bag forming station apparatus 38, at a constant linear speed $V_2$ equal to the linear output velocity $v_1$ of the film web 22 from the bag forming station 20. To provide tension control therefor, the folded web 22 is passed beneath a stationary roller 53, and over a pivotally mounted dancer roller 54 prior to being drawn into the winder mechanism 52 wherein it is wound upon a suitable storage roll (not illustrated).

Operably interposed between the bag forming station apparatus 38 and the winder mechanism 52 is a tie element attachment machine 60 which, as subsequently described, is utilized to secure to each of the individual bags B, adjacent its openable end, a plastic film closure tie element 62 as illustrated in FIGS. 3 and 5 which are top plan views of the laterally folded plastic film web 22 as it exits the machine 60. Machine 60 basically comprises a web handling portion $60_a$, and a closure tie element attachment portion $60_b$ which is mounted atop the web handling portion $60_a$ and is pivotable relative thereto between a lowered operating position (shown in solid lines in FIG. 1) and a raised access position (shown in phantom in FIG. 1).

As will be seen, the web handling portion $60_a$ operates to engage and leftwardly drive a longitudinally central portion of the folded web 22, positioned between the apparatus 38 and the winder mechanism 52, and to sequentially and momentarily stop each of the individual bags B and stationarily position a longitudinal section thereof for attachment thereto of the bag's associated closure tie element 62. Importantly, this intermittent stoppage of each of the individual bags moving from the apparatus 38 to the winder mechanism 52 is effected without appreciably altering the web output and intake linear velocities $v_1$ and $V_2$and without imposing upon the longitudinally moving web 22 undesirably high longitudinal tension forces which might otherwise tear the web at one of its perforation lines 50.

The tie element attachment portion $60_b$ of the machine 60 is appropriately synchronized with the web handling portion $60_a$, and is operative to form the individual tie elements 62, from a plastic film supply roll 64, and attach the formed tie elements to the sequentially stopped longitudinal sections of the individual bags B.

Before describing in detail the structure and operation of the tie element attachment machine 60, certain features of the tie elements 62 will be briefly described with reference to FIGS. 1 and 5–8. The representatively illustrated tie element supply roll 64 is formed from a lateral half of an elongated, flattened plastic film tube which has been cut along its central longitudinal axis with a heated slitting knife or wire. The lateral flattened web half used to form the tie element supply roll 64 thus defines an elongated, dual layer plastic film web 68 (FIG. 10) having a folded side edge 70 (FIG. 9), and an opposite, heat sealed edge 72 which was previously formed by the heated slitting knife or wire. It will be appreciated that, depending upon how the tie element web 68 was initially formed, both of the edges 70, 72 could be heat sealed edges. As will be seen, the web 68 is drawn through the tie element attachment portion $60_b$ of the machine 60 and is laterally cut into elongated strips that define the tie elements 62 which are secured to the individual bags B.

As best seen in FIGS. 5–7, each of the tie elements 62 has an inner end portion $62_a$ which includes a portion of the folded side edge 70 of the tie element web 68 and overlies the overhanging side edge portion $42_a$ of the laterally folded plastic film web 22. The tie element inner end portion $62_a$ is firmly secured to the web side edge portion $42_a$ by means of a circular heat web 74. As best illustrated in FIG. 6A, the held weld 74 extends through all four plastic film layers of the gusseted side edge portion $42_a$ of the folded web 22.

A longitudinally extending slit 76 is formed through the tie element end portion $62_a$, and the underlying web side edge portion $42_a$, and is positioned within the circular heat weld 74. From its secured inner end portion $62_a$, the tie element 62 extends longitudinally across the upper side surface of the folded web 22, with the tie element 62 being parallel to and adjacent the perforation line 50 that defines the openable end of the individual bag with which the particular tie element is associated.

The anchoring of the inner end of each tie element 62 (by the circular heat weld line 74) to all four layers of the gusseted side edge portion **42*a* of the folded web 22 provides a very strong interconnection between each tie element and its associated bag B. However, if desired, the side edge gusset 31 could be omitted (by omission of the gusset forming structure 27 shown in FIG. 1) so that the overhanging side edge portion of the folded web 22 would have only two plastic film layers (see the alternate side edge portion 42*b* in FIG. 4A). The inner end of each tie element 62 would then be heat welded (along the circular weld line 74) to the two film layers of the modified side edge portion 42*b***.

Each of the tie elements 62 also has an outer end portion $62_b$, containing a portion of the heat sealed side edge 72 of the tie element web 68, which is positioned laterally inwardly of the web fold 46. The heat sealed joint at the outer end of the tie element 62 is not particularly strong due to the fact that it was formed by a heated slitting knife or wire. Accordingly, a pair of laterally extending heat weld lines 78 are formed on the tie element 62 adjacent its outer end, in a manner subsequently described, to more firmly intersecure the two plastic film layers of the tie element in that region.

To releasably restrain the tie element 62 in place across the top side of the laterally folded plastic film web 22, so that the web 22 and the attached tie elements 62 may be smoothly drawn into the winder mechanism 52, five small dimples 80 (see FIGS. 7 and 7A) are formed in the outer tie element end **62*b* and are received in corresponding depressions 80*a* in the plastic web film layer beneath the tie element. As subsequently described, a heated die is used to form these dimples and depressions which are formed by a combination of mechanical force and thermoplastic distortion without appreciably heat welding the tie element end 62***b* to its associated bag. Accordingly, the tie element end 62*b* can later be pulled apart from the bag without tearing the bag. To use a tie element 62 to tie off and close the open end of its associated bag B, the outer end of the tie element 62 is simply pulled apart from the bag film layer to which it is releasably restrained by the interlocking dimples 80 and depressions 80*a*. After this is done, the tie element 62 remains very firmly anchored to its associated bag B by the circular heat weld 74 at the inner tie element end.

Figure 8:
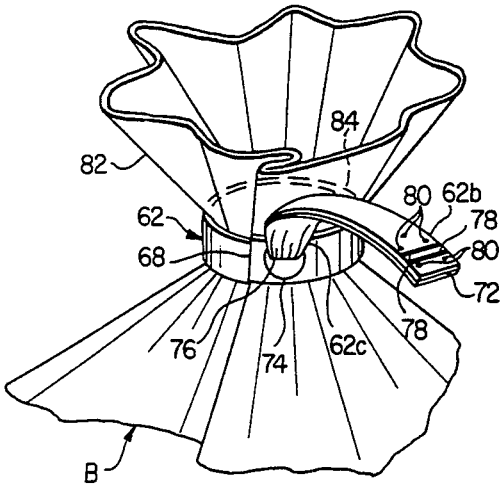
FIG. 8 is a perspective view of a portion of one of the plastic bags and illustrates the manner in which its associated tie element may be used to tightly close the bag.

As illustrated in FIG. 8, the tie element 62 may then be used to tightly close and seal the open end 82 of its associated bag B by simply wrapping the tie element 62 around the open bag end, passing the outer tie element end portion $62_b$ through the slit 76 to form a loop 84 around the open bag end, and then firmly pulling on the tie element to cinch the loop around the bag. The length of the slit 76 is preferably made somewhat shorter than the width of the tie element 62 which tends to crumple and gather the tie element as indicated at $62_c$, at its juncture with the slit, thereby substantially inhibiting loosening of the bag-closing tie element loop 84.

The illustrated closure tie element 62 is merely representative of a wide variety of tie element structures which could be attached to the individual bag portions of the laterally folded plastic film web 22. A variety of alternate closure tie element configurations are illustrated and described in U.S. application Ser. No. 117,209 which has been incorporated herein by reference.

Figure 9:
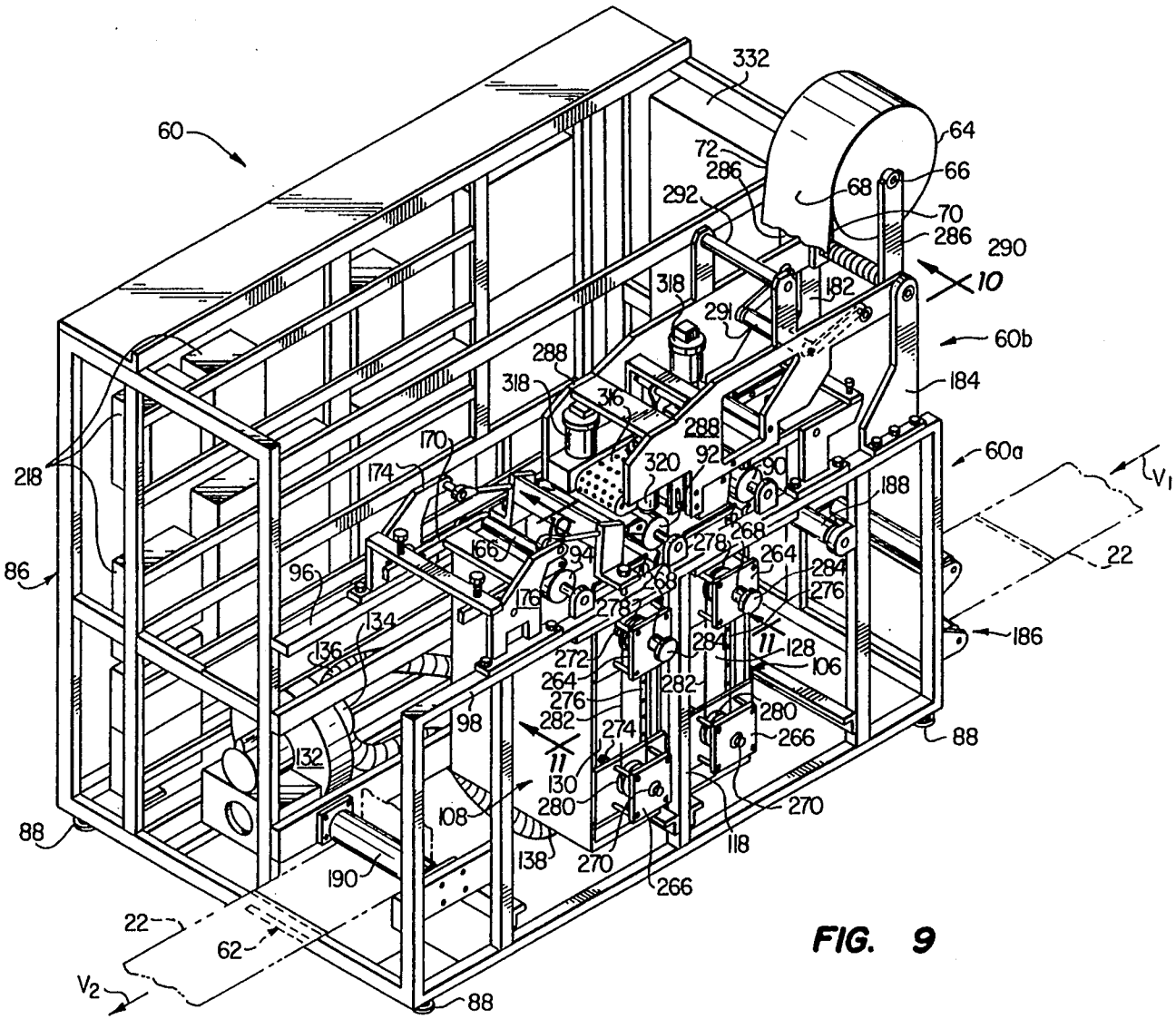
FIG. 9 is an enlarged scale, somewhat simplified perspective view of the tie element attachment machine.

Referring now to FIGS. 1 and 9, the tie element attachment machine 60 includes a generally rectangular support frame structure 86 which is floor supportable on four vertically adjustable support feet 88 positioned at the corners of the support frame structure. The web handling portion $60_a$ of the machine 60 is carried by a front side portion of the frame structure 86 and includes three drive roller members—an inlet drive roller 90, a central drive roller 92, and an outlet drive roller 94. As illustrated, the rollers 90, 92 and 94 extend horizontally, are laterally spaced apart, and are in essentially the same horizontal plane.

Figure 12:
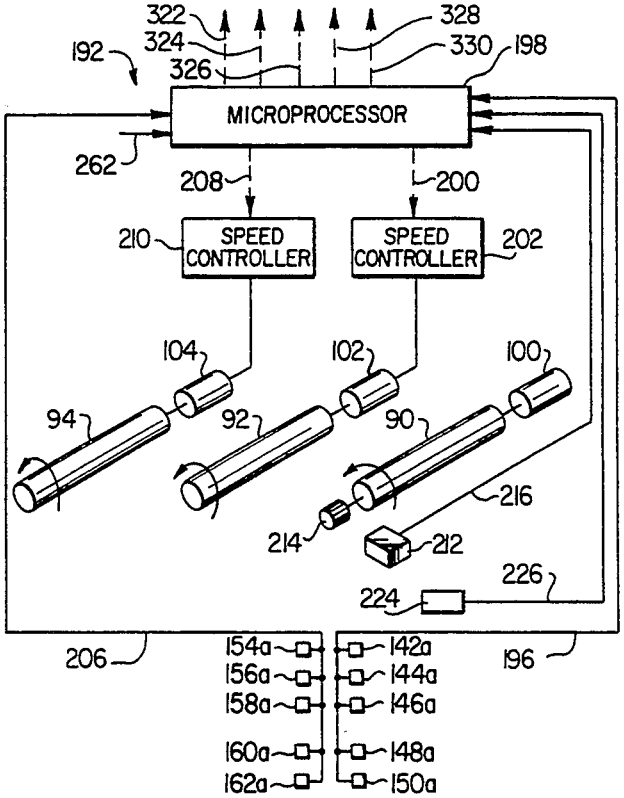
FIG. 12 is a schematic control diagram illustrating the feedback microprocessor control of inlet, outlet and central film web drive roller portions of the tie element attachment machine.

The three drive rollers longitudinally extend in a front-to-rear direction relative to the support frame structure 86, and are pivotally supported at their opposite ends on support frame portions 96 and 98. Roller 92 is spaced leftwardly from roller 90, and roller 94 is spaced leftwardly from roller 92. As schematically depicted in FIG. 12, the roller 90 is driven in a counterclockwise direction by a motor 100, roller 92 is driven in a counterclockwise direction by a stepper motor 102, and roller 94 is driven in a counterclockwise direction by a motor 104.

Figure 11:
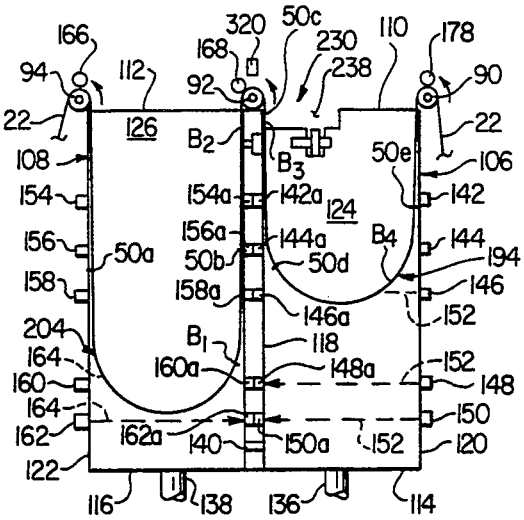
FIGS. 11 and 11A are schematic cross-sectional views taken through the tie element attachment machine along line 11-11 of FIG. 9, and sequentially illustrate the alternating movement of two slack plastic film web portions disposed within a vacuum bin section of the machine.

Supported by a front side portion of the support frame structure 86 directly beneath the rollers 90, 92 and 94 are a side-by-side pair of metal vacuum bins 106 and 108 (cross-sectionally illustrated in FIG. 11), bin 108 being positioned immediately to the left of bin 106. The vacuum bins 106, 108 have generally rectangular configurations, open top ends 110 and 112, bottom walls 114 and 116, a common central side wall 118, outer right and left side walls 120 and 122, rear walls 124 and 126, and front side walls 128 and 130. As illustrated in FIG. 11, roller 90 is positioned above and tangent to the bin wall 120, the roller 92 is positioned above the top end of the central bin wall 118 and is tangent to its opposite sides, and the roller 94 is positioned above and tangent to the bin wall 122.

For purposes later described, a vacuum pump 132 (FIG. 9) is supported by the frame structure 86 generally behind the left vacuum bin 108 and has an inlet 134. The inner ends of a pair of flexible vacuum hoses 136 and 138 are connected to the inlet 134, and the outer ends of the hoses 136, 138 are respectively connected to the bottom vacuum bin walls 114, 116 and communicate with the interiors of the bins 106, 108. The interiors of the vacuum bins 106, 108 communicate with one another via a transfer passage 140 formed through a lower end portion of the common central bin wall 118 and functioning to generally equalize the vacuums drawn in the two bins.

Also for purposes later described, a vertically spaced series of five photoelectric beam transmitting units 142, 144, 146, 148 and 150 are mounted on the right bin side wall 120 and are adapted to leftwardly transmit photoelectric beams 152 across the interior of vacuum bin 106 for receipt by a vertically spaced series of beam receiving members $142_a$-$150_a$ mounted on the central bin wall 118. In a similar fashion, a vertically spaced series of photoelectric beam transmitters 154, 156,158, 160 and 162 are mounted on the left bin side wall 122 and are operative to rightwardly transmit photoelectric beams 164 across the interior of the left vacuum bin 108 for receipt by a vertically spaced series of corresponding beam receiving units $154_a$-$162_a$.

Referring now to FIGS. 9 and 11, the web handling portion $60_a$ of the tie element attachment machine 60 also includes a pair of pinch rollers 166 and 168 which are rotationally carried at their outer ends by arm members 170, 172. The inner ends of the arm members 170, 172 are pivotally carried by a pair of upright support plate structures 174 and 176 which project upwardly from left end sections of the support frame portions 96, 98. As illustrated, the arm members 170, 172 are downwardly pivotable to respectively position the pinch rollers 166, 168 against upper portions of the outlet drive roller 94 and the central drive roller 92. A third pinch roller 178 is similarly carried on a pair of arms 180 pivotally secured at their inner ends to a pair of upright support bracket structures 182, 184 positioned along right end sections of the support frame portions 96, 98. The arms 180 are downwardly pivotable to position the pinch roller 180 against an upper portion of the inlet drive roller 90.

Referring now to FIGS. 1 and 11, the laterally folded plastic film web 22 exiting the bag forming station apparatus 38 is extended through a conventional web guide apparatus 186, secured to a right end portion of the support frame structure 86, which functions to automatically maintain proper lateral alignment of the web during operation of the overall system. Upon leftwardly exiting the web guide apparatus 186, the web 22 sequentially passes beneath a guide roller 188, between the drive and pinch roller sets 90 and 180, 92 and 168, and 94 and 166, beneath a guide roller 190, beneath the stationary roller 53, and over the pivotally mounted dancer roller 54 and upwardly into the winder mechanism 52. Utilizing the subsequently described control system 192 (FIG. 12), start-up of the web handling portion $60_a$ of the machine 60 is effected as follows.

Figure 15:
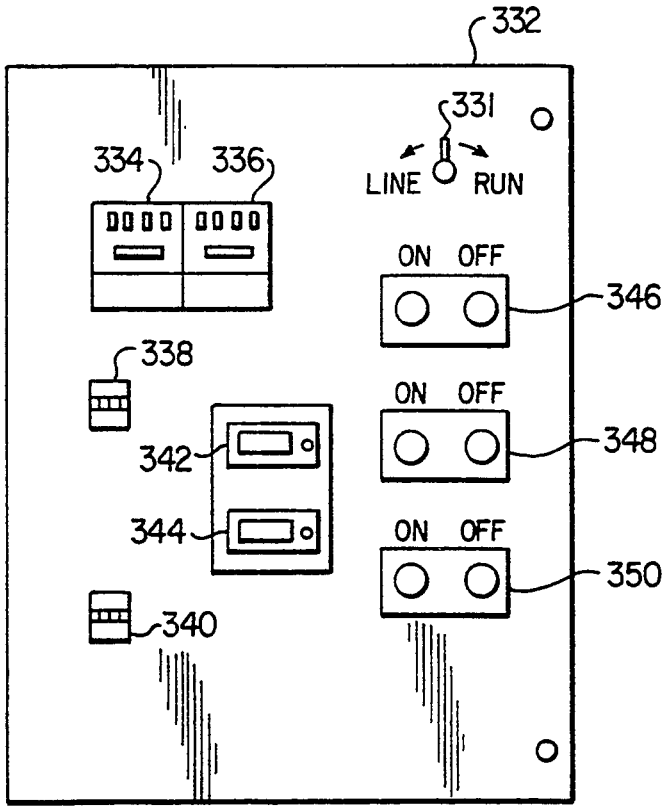
FIG. 15 is a front side elevational view of a main control panel portion of the tie element attachment machine.

The web 22 is loaded into the tie element attachment machine 60 by initially passing the web under roller 188, resting the web atop the three drive rollers 90, 92 and 94, and passing the web beneath roller 190 and operatively connecting it to the winder 52. A switch 331 on a main control panel 332 (FIG. 15) is then moved to its "LINE" position which, via a microprocessor 198 (FIG. 12), initiates the operation of rollers 90 and 94 at rotational speeds corresponding to the linear web velocity $v_1$.

When it is desired to attach tie elements to the web 22, an operator moves the switch 331 from its "LINE" position to its "RUN" position. This signals the microprocessor 198 to energize the vacuum pump 132 (FIG. 9) and slow the rotation of roller 94 via an output signal 208 transmitted to its speed controller 210. The slowing of roller 94 causes the web 22 to be pulled downwardly into the vacuum bin 106. In a manner subsequently described, when web 22 downwardly reaches a predetermined level within bin 106, the microprocessor 198 transmits an output signal 200 to speed controller 202 (FIG. 12) to rotationally "step" the roller 92 at a rotational velocity greater than the linear velocity $v_1$, permitting the web 22 to be vacuum-drawn downwardly into bin 108 into a looped configuration 204 until, in a manner subsequently described, the corresponding web loop 194 in bin 106 is shortened and the loops 194 and 204 are in their relative length relationship illustrated in FIG. 11. In such length relationship the loop 204 is considerably longer than loop 194.

After this initial length relationship between the web loops 194, 204 is achieved, the microprocessor 198 signals speed controller 210 to operate roller 94 at a rotational speed equal to that of roller 90 to maintain the web loops in this initial length relationship. Upon attainment of this condition, the switch 331 is moved to its "RUN" position which, via the microprocessor 198, lowers the tie element portion $60_b$ of machine 60 to be lowered into its operative position.

During the start-up, with the folded plastic film web 22 being outputted from the sealing, folding and perforating apparatus 38, the motor 100 rotationally drives the inlet roller 90 at a constant torque and at a counterclockwise, variable rotational speed corresponding to the linear web output speed $v_1$ so that the web takeup speed of the roller 90 is equal to the linear web output speed from the apparatus 38. The above-described slowing of roller 94 forms a slack portion of the web 22 between the rotating drive roller 90 and the stationary central drive roller 92. The operation of the vacuum pump 132 (FIG. 9) creates a yielding vacuum force within the vacuum bin 106 which draws this slack web portion downwardly into bin 106 and gently holds it in the illustrated, downwardly looped configuration 194 (FIG. 11). As the roller 90 continues to rotate, the vertical length of the web loop 194 downwardly increases.

The increasing length of the web loop 194 is continuously monitored by the photoelectric beam receivers $142_a$-$150_a$ supported on the central bin wall 118. It can be seen in FIG. 11 that as the web loop 194 extends further downwardly within the bin 106 it sequentially blocks downwardly successive ones of the photoelectric beams 152. When the lower end of the loop web 194 downwardly reaches a predetermined vertical level within the bin 106, a combinative signal 196 (FIG. 12) is transmitted from the receivers $142_a$-$150_a$ to a microprocessor 198, the signal 196 indicating that the vertical length of the web loop 194 has reached its desired magnitude.

Upon receiving the signal 196, indicating that the web loop 194 has reached its desired initial length within the bin 106, the microprocessor 198 responsively transmits an output signal 200 to the speed controller 202 which in turn, operates the motor 102 to step the central drive roller 92 at a faster speed than the inlet roller 90, thereby initiating the formation of web loop 204. The stepped rotation of the central drive roller 92 increases the length of the resulting slack web portion between the rollers 92, 94, the vacuum force within the left bin 108 exerting a yielding downward force on this second slack web portion to convert it to the second downwardly extending web loop 204. When the bottom end of the web loop 204 is properly positioned within bin 108 (see FIG. 11), the photoelectric receivers transmit through the microprocessor 198 a combinative signal 206 indicative of the fact that the left web loop 204 has now reached its desired initial vertical length.

Microprocessor 198 then responsively transmits an output signal 208 to a speed controller 210 which operates the motor 104 to initiate a change in rotation of the outlet drive roller. The roller 94 is driven at a rotational speed identical to that of the inlet drive roller 90 via the operation of a magnetic speed sensor 212 that monitors the rotational speed of a small gear member 214 secured to the front end of the inlet drive roller 90 for rotational therewith. Speed sensor 212 responsively transmits to the microprocessor 198 a rotational speed-indicative output signal 216 which, in a feedback manner, is operative to adjust the output signal 208 to the speed controller 210, to thereby equalize the rotational speeds of the inlet and outlet drive rollers 90, 94. With the three drive rollers 90, 92 and 94 being operated at essentially constant speeds, the heights of the web loops 194 and 204 are maintained in their length relationship illustrated in FIG. 11 during the start-up phase of machine operation.

The microprocessor 198, and the speed controllers 202 and 210, are conveniently positioned within a rear side portion of the support frame structure 86 (FIG. 9) along with various other control components generally indicated by the reference numeral 218. After the previously described start-up procedure has been accomplished, the web handling position $60_a$ of the machine 60 is converted to its normal operating mode by moving switch 331 to its "RUN" position. In this operating mode, the inlet and outlet drive rollers 90, 94 are still rotated at constant and essentially identical speeds, but the central drive roller is sequentially started and stopped to sequentially and stationarily position longitudinal sections of each individual bag B, adjacent its perforation line 50 that defines its openable end, to ready such longitudinal bag sections for the attachment thereto of the tie elements 62 in a manner subsequently described.

Quite importantly, this sequential stoppage of each individual bag B at the central drive roller 92 is accomplished without appreciably altering the constant output and intake velocities $v_1$ and $v_2$ of the longitudinally moving folded plastic film web 22 as it approaches and exits the tie element attachment machine 60° Additionally, as will be seen, due to the unique formation of the web loops 194 and 204 such individual bag stoppage is effected without imposing upon the web 22 undesirable longitudinal tension forces which might otherwise tear the web at one of its perforation lines 50. The unique achievement of these two very desirable results will now be described in conjunction with FIGS. 11 and 11A.

Figure 11A:
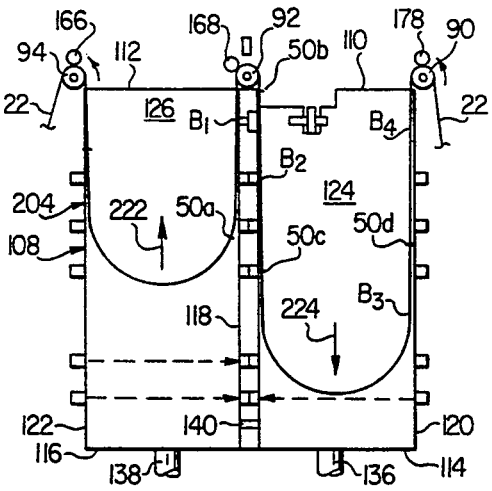

In FIG. 11A, the central drive roller 92 has been stopped, during the continuing rotation of the inlet and outlet drive rollers 90 and 94, to thereby momentarily hold the bag portion $B_1$ thereon with the openable end perforation line $50_b$ of the bag $B_1$ being rightwardly adjacent the central drive roller 92, and the opposite end perforation line $50_a$ of the bag $B_l$ being positioned upon the web loop 204 being vacuum-drawn downwardly into the bin 108 through its open upper end 112. The longitudinal section of the stopped bag $B_l$ positioned atop the now stationary central drive roller 92 corresponds to the longitudinal section of such bag to which its closure tie element 62 will be affixed.

During its momentary stoppage, the central drive roller 92 does not, of course, continue to drive a left side portion of the right web loop 194 into the left vacuum bin 108. However, the continued rotation of the inlet and outlet drive rollers 90, 94 continues to feed the web 22 into the right vacuum bin 106, and withdraw the web 22 from the left vacuum bin 108. This functions to lengthen the web loop 194, while shortening the web loop 204, as respectively indicated by the arrows 220 and 222 in FIG. 11A. The left web loop 204 is shortened against the downwardly directed vacuum force imposed thereon by the vacuum pump 132. Accordingly, the tension force exerted on the web loop 204 by the continuously rotating outlet drive roller 94 in insufficient to tear any of the web perforation lines disposed within the left vacuum bin 108—all the outlet drive roller 94 does during this period in which the central drive roller 92 is momentarily stopped, is take up the slack in the left web loop 204.

After its tie element 62 is secured to the momentarily stopped bag $B_1$, as monitored by an appropriate sensor 224 (FIG. 12), the sensor 224 transmits an output signal 226 to the microprocessor 198 indicating that the tie element has been attached. The roller 92 is not commanded to rotate until photocell 150 is covered by web loop 194, at which time the output signal 196 is transmitted to microprocessor 198. When the signal 196 is received by the microprocessor, the microprocessor automatically adjusts its output signal 200 to the speed controller 202 to operate the stepper motor 102 in a manner such that the central drive roller 92 is sequentially started and rotationally accelerated to a counterclockwise rotational speed higher than the speeds of the inlet and outlet drive rollers 90 and 94, maintained at this elevated speed for a predetermined time period, decelerated, and stopped.

The result of this speed control cycle of the central drive roller 92 is that at the moment of its stoppage subsequent to the attachment of the tie element to the bag $B_1$, the right web loop 194 has been re-lengthened, and the left web loop 204 reshortened, to their original lengths as depicted in FIG. 11. Additionally, the next bag $B_2$ has been stopped at the central drive roller 92, with the openable end perforation line $50_c$ of bag $B_2$ positioned rightwardly adjacent the roller 92, and the opposite perforation line $50_b$ being now positioned within the left vacuum bin 108.

After this stoppage of the central drive roller 92, which readies the bag $B_2$ for the attachment of its tie element thereto, the web loops 194, 204 again begin to respectively lengthen and shorten as illustrated in FIG. 11A. The elevated speed level of the central drive roller 92, which shortens the web loop 194, does not impose undesirably high longitudinal tension force on the loop 194, since the roller 92 merely takes the slack out of the previously lengthened loop 194 against the yielding, downwardly directed vacuum force on such loop within the right vacuum bin 106.

It can thus be seen that the web handling apparatus of the present invention, by means of the formation and length control of the two web loops 194 and 204, permits the sequential stoppage of each individual bag without overstressing the web 22 or appreciably altering the linear output and intake speeds $v_1$and $v_2$ of the web.

It will be appreciated that the microprocessor 198 may be easily programmed to operate the speed controller 202 such that, during each period in which the drive roller 92 is rotated, the stepper motor 102 inputs the proper number of rotational "steps" to the central drive roller 92. The roller 92 sequentially advances the web a distance equal to the length of the individual bags being produced, and that the time period between stoppages of the roller 92 is coordinated to essentially equalize the lengths of the web loops 194, 204 each time the central drive roller is stopped.

In addition to precisely controlling each web advancement length of the roller 92, it is also important to insure that as each individual bag is stopped at the central drive roller, the openable end perforation line of such bag is properly positioned relative to the stopped roller so that each attached tie element is properly positioned on its associated bag. In the present invention, this is achieved by the use of a specially designed perforation detection system 230 which is illustrated in FIGS. 11, 11A, 13 and 14.

The perforation detection system 230 includes a high voltage electrode member encased in an insulation tube 232 which is mounted on the outer end 234 of an L-shaped support arm 236 which extends rearwardly through an opening 238 formed in the rear side wall 124 of the right vacuum bin 106 adjacent its upper end and the upper end of the central bin wall 118. The inner end 240 of the support arm 236 is positioned behind the bin wall 124 and is secured to a pivot pin member 242 which permits the support arm 236 to pivot about a horizontal axis, as indicated by the double-ended arrow 244 in FIG. 13, between an operating position shown in FIG. 13 and a stowage position in which the electrode 232 and the outer end 234 of the support arm 236 are rearwardly pivoted through the bin wall opening 238 and are withdrawn from the vacuum bin 106.

With the support arm 236 forwardly pivoted to its operating position, the portion of the support arm extending forwardly through the bin wall opening 238 rests upon and is supported by a horizontally extending tab portion 246 of the rear side bin wall 124, and the left or discharge end $232_a$ of the electrode 232 is positioned slightly rightwardly of the central bin wall 118.

Directly to the left of the inner electrode end $232_a$ is a circular opening 248 formed in the central bin wall 118. As cross-sectionally illustrated in FIG. 14, a cylindrical insulator member 250 has a boss portion 252 positioned within the bin wall opening 248, and a grounded cylindrical metal conductor member 254 extends coaxially through the insulator member 250, the exposed right end of the conductor member 254 facing the inner end $232_a$ of the electrode 232.

Figure 14:
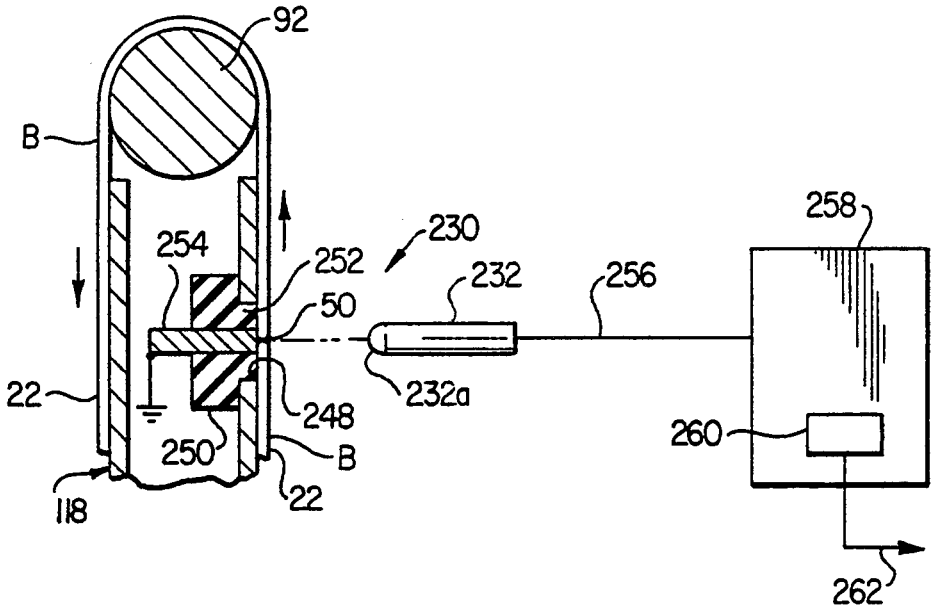
FIG. 14 is a schematic cross-sectional view through the perforation detection system, taken generally along line 14—14 of FIG. 13, and additionally illustrates certain control circuitry associated therewith

As illustrated in FIGS. 11 and 14, a left side portion of the right web loop 194 is routed upwardly between the electrode 232 and the insulator 250 onto the central drive roller 92. Accordingly, during operation of the tie element attachment machine 60 the web perforation lines 50 are sequentially passed between the electrode 232 and the conductor 254. The electrode 232 is connected via a lead 256 to a high voltage power supply device 258 which functions to create a high voltage potential across the gap between the electrode 232 and the conductor 254. Electrical discharge between the electrode 232 and the conductor 254 is normally prevented by the high dielectric constant of the plastic film material of the web 22 positioned in such gap.

However, each time a perforation line passes through this gap, an electrical discharge occurs from the electrode 232, through the perforation line, to the conductor 254, and then through the conductor to ground. This creates a current flow from the electrode to ground, which is sensed by a current sensor 260 that responsively transmits a current-indicative output signal 262 to the microprocessor 198 (see FIG. 12). In this manner, a precise monitoring of the position of the openable end perforation line of each of the individual bags is achieved so that when each individual bag is stopped at the central drive roller 92, the longitudinal section of each individual bag to which its tie element is to be attached is also precisely positioned.

Should the control system 192 detect a deviation in the desired position of the openable end perforation line 50 when a particular bag is stopped at the central drive roller (such deviation being caused for example, by roller slippage) the microprocessor 198 automatically functions to adjust the signal 200 being transmitted to the speed controller 202 to momentarily increase or decrease the counterclockwise rotational steps of the roller 92 to readjust the stopped bag position on the central drive roller 92, and correspondingly adjust the signal 200 to increase or decrease the total number of rotational "steps" imparted to the central drive roller 92 during one start-stop rotational cycle thereof, thereby properly readjusting the longitudinal orientation of each individual bag as it is stopped at the central drive roller 92.

Normally, the rotational speeds of the inlet and outlet drive rollers 90, 94 are the same. However, at certain web velocities and bag lengths, the web loop 204 in the vacuum bin 108 may become too long or too short during the tie element attachment process. When the web 204 is too long (such as, for example the photocells 160 or 162 are covered by the loop 204), the microprocessor is signalled and responsively causes the controller 210 to temporarily increase the rotational speed of roller 94. In a similar fashion, when web loop 204 becomes too short (such as, for example, when photocells 156 and 158 are uncovered), an appropriate signal is sent to the microprocessor which, in turn, temporarily slows the rotational speed of roller 94.

The pivotal mounting of the electrode 232 on the L-shaped support arm 236 functions to prevent the web 22 from being torn at one of its perforation lines 50 in the event that the right web loop 194 is shortened to an extent that its lower end contacts the outer end 234 of the support arm 236. In the event that this occurs, the web merely pivots the support arm 236 rearwardly to its stowed position in which it is disposed entirely behind the bin wall 124 by movement through the bin wall opening 238 as previously described.

The control system 192 described in conjunction with FIG. 12 is, of course, adjustable to compensate for different bag lengths being driven through the web handling portion $60_a$ of the tie element attachment machine 60, the bag length being the distance between sequentially adjacent pair of perforation lines 50. The web handling portion $60_a$ may also be easily adjusted to compensate for folded webs of different widths. This width adjustment is achieved in the present invention by providing means for selectively varying the effective front-to-rear widths of the vacuum bins 106 and 108. Such bin width adjustment is obtained by mounting the front bin walls 128, 130 for selective front and rear movement relative to the balance of the bins.

Referring now to FIG. 9, upper and lower support members 264 and 266 are suitably secured between the central bin wall 118 and the outer side walls 120, 122 of the vacuum bins. Internally threaded nut members 268,270 are captively retained on the upper and lower support members 264,266 for rotation relative thereto and threadingly receive elongated externally threaded rod members 272, 274 welded at their inner ends to the movable front bin walls 128, 130. Along their opposite vertical sides, the front bin walls 128, 130 are provided with resilient seal members 276 which slidingly engage the opposite left and right side walls of each bin.

Sprocket members 278, 280 are respectively secured to the upper and lower nut members 268 and 270, and are drivingly interconnected by suitable chains 282. The upper nut members 268 have secured thereto suitable adjustment knobs 284 which may be rotated to effect forward or rearward movement of their associated front bin walls. For example, as viewed in FIG. 9, clockwise rotation of one of the adjustment knobs 284 effects forward movement of its associated front bin wall, while counterclockwise rotation of the adjustment knob causes rearward movement of the front bin wall. In this manner, front-to-rear width adjustment of the two vacuum bins may be obtained so that the front-to-rear width of the bins is just slightly larger than the width of the folded plastic film web being used in a particular bag run. This width adjustment capability assures that the downward vacuum force applied to the web loops in each of the bins is efficiently applied to such loops.

The web handling apparatus $60_a$ just described is particularly well suited to its illustrated use in handling the folded plastic film web 22 used in the in-line production of plastic bags in which it is necessary to momentarily stop longitudinally spaced apart sections of the continuously moving web to secure flexible tie elements to the stopped web sections. However, it will be readily appreciated that the unique structure and operation of the web handling apparatus would also be quite useful for the performance of operations other than tie element attachment—for example, in printing, attachment of auxiliary components of other types, and the like.

Figure 10:
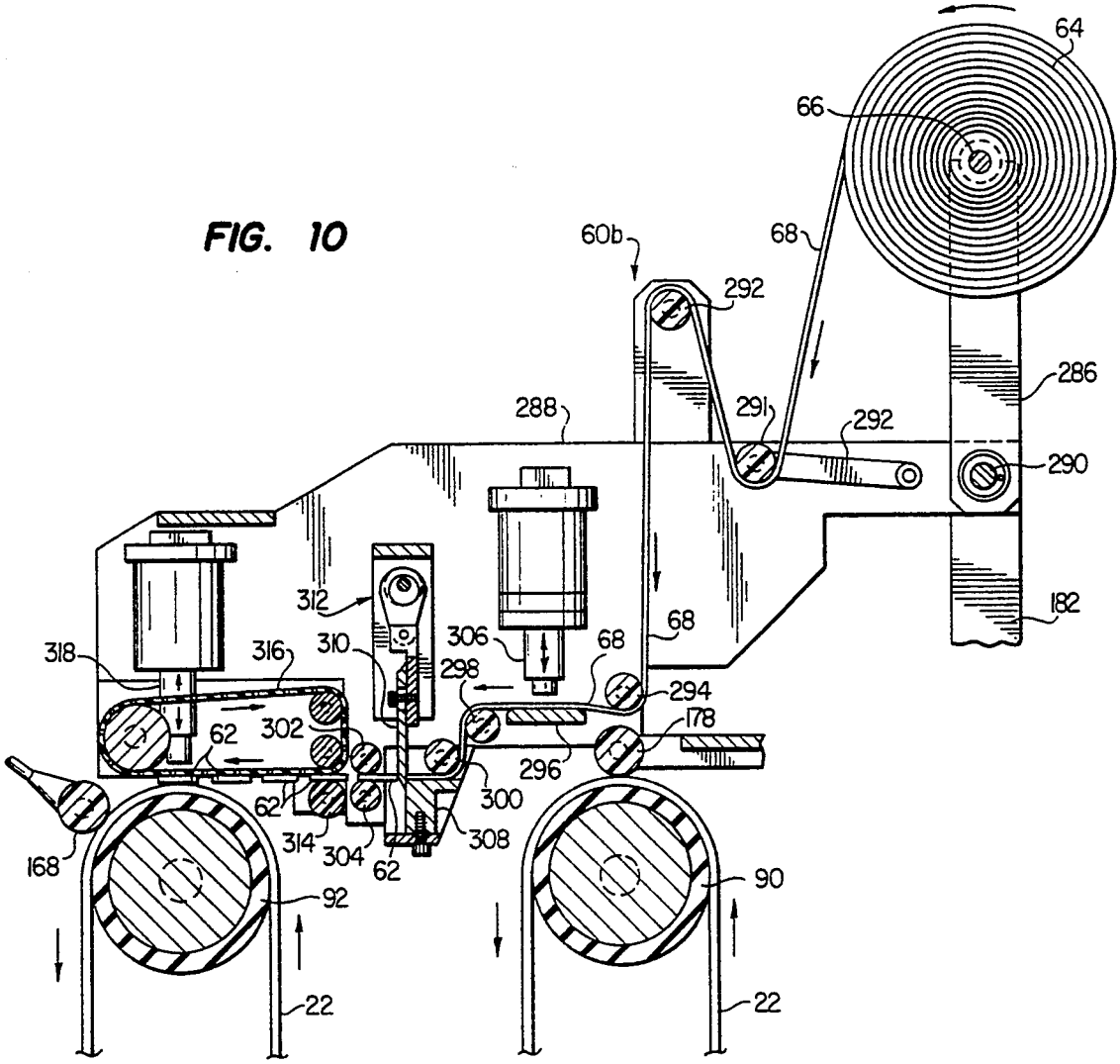
FIG. 10 is an enlarged scale partial cross-sectional view through the tie element attachment machine taken along line 10—10 of FIG. 9.
Figure 13:
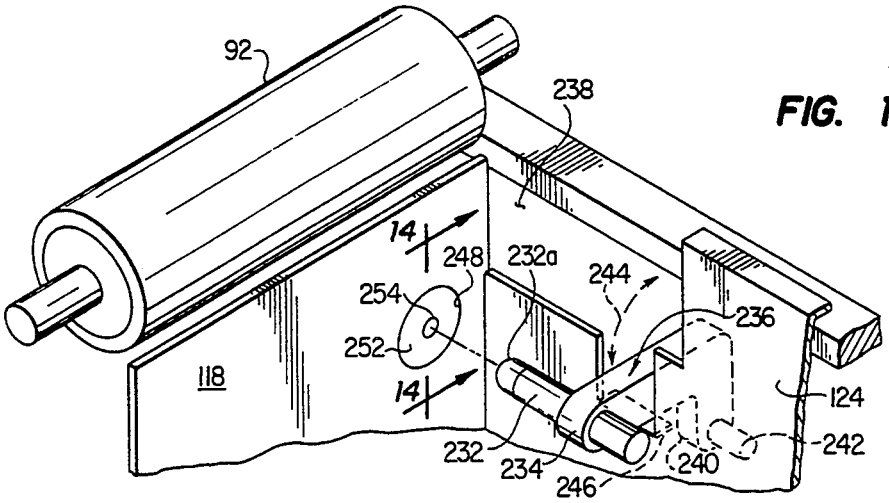
FIG. 13 is an enlarged scale fragmentary perspective view of a bag perforation detection system portion of the tie element attachment machine.

Turning now to FIGS. 9 and 10, the tie element attachment portion $60_b$ of the machine 60 will be described in detail. The support spindle 66 of the tie element supply roll 64 is rotationally supported on the upper ends of a pair of upright support bars 286 extending upwardly from the support brackets 182, 184 positioned at a right front corner portion of the support frame structure 86 as previously described. Extending leftwardly from the support brackets 182, 184 are a spaced pair of support arm structures 288. The support arm structures 288 are secured to the brackets 182, 184 and are pivotally carried by a support rod structure 290 so that the tie element roll 64, the support bars 286, and the support arm structures 288 may be pivoted between the solid line, lowered operating position of the tie element attachment portion $60_b$ and its dotted line raised access position schematically depicted in FIG. 1.

As best seen in FIG. 10, the tie element web 68 extends downwardly from the supply roll 64 and is passed under a dancer roller 291 which is pivotally carried on support arms 292 secured at their inner ends to the brackets 182 and 184. The web 68 then passes upwardly around an upper guide roller 292, beneath a lower guide roller 294, and across a support plate member 296 extending between and supported by the support arm structures 288. As it leftwardly exits the support plate member 296, the web 68 passes over a guide roller 298 and wraps around a drive roller 300 which advances the web 68 a predetermined length into a vertically opposed pair of drive rollers 302, 304 that operate to pull each sheared-off tie element 62 from a shearing knife 310.

As the web 68 is drawn leftwardly along the upper side surface of the support plate member 296, a vertically reciprocating heating die 306, carried by the left support arm structure 288 and positioned above the support plate member 296, forms the weld lines 78 (FIG. 7) on longitudinally spaced apart sections of the leftwardly moving tie element web. As the web, with the weld lines 78 thereon, leftwardly exits the guide roller 300, it passes between the base and reciprocating knife portions 308 and 310 of a vertically reciprocating slitting knife mechanism 312. Operation of the vertically reciprocating knife 310 transversely separates the individual tie elements 62 from the leftwardly moving web 68. As each individual tie element 62 exits the slitting mechanism 312 it is drivingly engaged by the drive rollers 302, 304 and moved leftwardly between a pinch roller 314 and the bottom side of a rotationally driven vacuum belt 316 positioned over the central drive roller 92.

As illustrated in FIG. 10, clockwise rotation of the vacuum belt leftwardly transports the individual tie elements 62, and positions the leftmost tie element directly above the central drive roller 92 and the longitudinal section of the folded plastic film web 22 momentarily stopped thereon. With the leftmost tie element 62 stopped in this position, its inner end portion $62_a$ extends forwardly beyond the font side edge of the vacuum belt and is positioned over the overhanging side edge portion $42_a$of the folded web 22 (FIG. 4), and its outer end portion $62_b$(which extends outwardly beyond the rear side edge of the vacuum belt) is positioned as illustrated in FIG. 5.

To attach the leftmost tie element 62 to the particular individual bag stopped at the central drive roller 92, a pair of reciprocating heating dies 318 and 320 are mounted at the left ends of the support arm structures 288 and are respectively positioned over the outer and inner end portions of the leftmost tie element depicted in FIG. 10 which laterally extend beyond the opposite side edges of the vacuum belt. The heating die 318 is utilized to form the small circular dimples 80 (FIG. 7) on the outer end of the leftmost tie element 62, and the heating die 320 is used to form the circular weld line 74, and the slit 76, on the inner end portion of the tie element.

It will be appreciated that the rate of advancement of the individual tie elements formed from the leftwardly advancing web 68 in the tie element attachment portion $60_b$ of the machine 60 is appropriately and intermittently sequenced relative to the sequence and speed of folded web advancement at the central drive roller 92. This sequencing is conveniently achieved using the microprocessor portion 198 of the control system 192 schematically depicted in FIG. 12. The microprocessor, in response to the tie element attachment output signal 226, transmits output signals 322, 324, 326, 328 and 330. Output signal 322 is indicative of the stoppage of the stepper motor 102, output signal 324 is indicative of the reciprocating dies 318, 320 being in their downward position, output signal 326 is indicative of such dies being in their upward position, output signal 328 operates the slitter 312, and output signal 330 advances the tie element web 68 through its next increment. These signals, of course, are appropriately interrelated to position signals associated with the web handling portion of the tie element attachment machine.

As previously mentioned, and as schematically illustrated in FIG. 1, the tie element attachment portion $60_b$ of the machine 60 is pivotable between a lowered, solid line operating position and a raised, dotted line access position. According to a feature of the present invention, appropriate control means 331 (FIG. 1) are provided to monitor the cooperative operation of the machine portions $60_a$ and $60_b$ when the tie element attachment portion $60_b$ is in its lowered position and the bag web 22 is being leftwardly conveyed as previously described. In the event of a machine malfunction, such as a jamming of the machine portion $60_b$, or a deviation in one or both of the bag web loop lengths from its maximum or minimum permissible length, the schematically depicted control means 331 are operative to upwardly pivot the machine portion $60_b$ (by operating suitable drive means not illustrated) to its access position while the bag web 22 continues to be produced and run through the machine 60.

To effect this automatic upward pivoting of the machine portion $60_b$, appropriate condition signals $331_a$, $331_b$ are transmitted to control means 331 from the microprocessor 198, the signal $331_a$ being indicative of sensed operating condition of the machine portion $60_a$, and the signal $331_b$ being indicative of a sensed operating condition of the machine portion $60_b$. If either signal $331_a$ or $331_b$ is indicative of a malfunction of its associated machine portion the control means 331 output a signal $331_c$ to energize the aforementioned drive means which, in turn, upwardly pivot the machine portion $60_b$. The control means 331 may, at this time, also transmit an output signal $331_d$ used to energize an audible alarm (not illustrated).

The overall operation of the machine 60 is adjusted and controlled by the main control panel 332 (FIG. 15) which, as seen in FIG. 9, is positioned on the right end of the support frame structure 86. The panel 332 includes heating temperature controls 334, 336 for the tie element weld lines 74 and 78, and the dimples 80, and a heat seal time control 338 for these areas. A length adjustment dial structure 340 is provided for inputting to the machine the length of the individual bags being driven therethrough. To monitor the number of bags which have passed through the machine 60, appropriate cumulative counters 342, 344 are also provided. Finally, appropriate on-off switch controls 346, 348, 350 are respectively provided to control the power, tie element attachment, and transport functions of the tie element attachment machine.

The foregoing detailed description is to be clearly understood as being given by way of illustration and example only, the spirit and scope of the present invention being limited solely by the appended claims.

What is claimed is:

1. A method of manufacturing plastic film bags comprising the steps of:

continuously extruding a plastic film tube;

flattening the tube to a web configuration having a duality of opposite side edge portions;

forming a longitudinally spaced series of transversely extending heat weld lines on the web to define the closed ends of a series of bag portions on the web;

laterally folding the web to a configuration in which one of said side edge portions projects outwardly from the balance of the laterally folded web;

anchoring the one end of each of a series of enlongated flexible bag tie elements to said outwardly projecting side edge portion of the laterally folded web at longitudinally spaced locations thereon adjacent what will be the open ends of the bags being formed, each tie element having a free end adapted to be looped around and tightly close the open end of its bag; and continuously conveying the laterally folded web, with said tie elements anchored thereto, to a receiving location.

2. A method of fabricating a bag from a thin thermoplastic tube in which the bottom of the bag is formed by a transverse heat seal and the top of the bag is openable by separating the tube, the bag having one end of an elongated tie element attached to one edge of the bag with the other end of the tie element free, to be wrapped around the neck of the bag to close the open end, comprising the steps of:

continuously extruding a thin film bag tube of the thermoplastic material and flattening the tube into a bag web having opposite side edges;

sequentially forming a series of transverse heat seals at spaced intervals along the tube to form the bottoms of the respective bags, while moving the bag web along a line;

simultaneously moving a thin film tie element web along a controlled path to a heat welding element positioned at one edge of the bag web, while cutting short lengths transversely from the end of the tie element web to form successive elongated tie elements, heat welding each tie element to the edge of each bag at a point spaced from the transverse heat seal, and at least partially separating the bag web between the tie element and the transverse heat seal to permit the individual bags to be separated and form the open top of the bags.

3. A method of fabricating a bag from a thin thermoplastic tube in which the bottom of the bag is formed by a transverse heat seal and the top of the bag is openable by separating the tube, the bag having one end of an elongated tie element attached to one edge of the bag with the other end of the tie element free, to be wrapped around the neck of the bag to close the open end, comprising the steps of:

continuously extruding a thin film bag tube of the thermoplastic material and flattening the tube into a bag web having opposite side edges;

sequentially forming a series of transverse heat seals at spaced intervals along the tube to form the bottoms of the respective bags, while moving the bag web along a line;

simultaneously moving a thin tubular flattened double layered film tie element web along a controlled path to a heat welding element positioned at one edge of the bag web, while cutting short lengths transversely from the end of the tie element web to form an elongated tie element, heat welding both layers of each tie element to both layers of the edge of each bag at a point spaced from the transverse heat seal, and at least partially separating the bag web between the tie element and the transverse heat seal to permit the individual bags to be separated and form the open top of the bags.

4. A method of fabricating a bag from a thin thermoplastic tube in which the bottom of the bag is formed by a transverse heat seal and the top of the bag is openable by separating the tube, the bag having one end of an elongated tie element attached to one edge of the bag with the other end of the tie element free, to be wrapped around the neck of the bag to close the open end, comprising the steps of:

continuously extruding a thin film bag tube of the thermoplastic material, forming a gusset in one edge of the tube to form a four layered section along one side and flattening the tube into a bag web having opposite side edges;

sequentially forming a series of transverse heat seals at spaced intervals along the tube to form the bottoms of the respective bags, while moving the bag web along a line;

simultaneously moving a thin film tie element web along a controlled path to a heat welding element positioned at one edge of the bag web, while cutting short lengths transversely from the end of the tie element web to form an elongated tie element, heat welding each tie element to all four layers of the edge of each bag at a point spaced from the transverse heat seal, and at least partially separating the bag web between the tie element and the transverse heat seal to permit the individual bags to be separated and form the open top of the bags.

5. A method of forming elongated flexible bag tie elements and operatively securing them to individual bag portions defined on a longitudinally moving plastic film bag web having a side edge portion projecting outwardly from the balance of the moving bag web, said method comprising the steps of:

longitudinally moving a plastic film tie element web having two plastic film layers along a controlled path;

sequentially severing successive longitudinal segments from the moving tie element web to form a series of elongated flexible bag tie elements;

transversely conveying each of the tie elements to a position in which it longitudinally extends transversely across an exterior side surface portion of the bag web with an inner end portion of the tie element overlying said side edge portion of the bag web; and heat sealing the inner ends of the tie elements to said side edge portion of the bag web at longitudinally spaced locations thereon.

6. The method of claim 5 further comprising the step of:

releasably securing the outer ends of the tie elements to said exterior side surface portion of the bag web.

7. The method of claim 5 wherein:

said step of transversely conveying is performed by transferring each tie element to a rotating vacuum belt, with the outer end portion of the tie element projecting laterally outwardly of the vacuum belt, which is operative to move the tie element to said position thereof.

8. The method of claim 5 further comprising the step of:

temporarily stopping successive, longitudinally spaced sections of the bag web during the performance of said step of said heat sealing step.

9. The method of claim 5 wherein:

said heat sealing step is performed by forming a heat seal line extending along at least a portion of a non-linear closed path.

10. The method of claim 9 further comprising the step of:

forming a slit through each tie element inner end portion.

11. The method of claim 10 wherein:

said heat sealing step is performed by forming a generally circular heat weld line, and said step of forming a slit is performed in a manner positioning the slit within said generally circular heat weld line.

12. The method of claim 5 further comprising the step of:

heat sealing an edge portion of the tie element to weldingly reinforce what will be the outer ends of the tie elements.

* * * * *